United States Patent [19]

Tanaka

[11] Patent Number: 5,054,274

[45] Date of Patent: Oct. 8, 1991

[54] AUTOMATIC MOLTEN SUBSTANCE BAGGING METHOD AND SYSTEM

[76] Inventor: Sokichi Tanaka, 4-4-1106, Shiba-Daimon 1-chome, Minato-ku, Tokyo, Japan

[21] Appl. No.: 579,503

[22] Filed: Sep. 10, 1990

[51] Int. Cl.[5] ..... B65B 43/26

[52] U.S. Cl. ..... 53/570; 53/171; 53/579; 53/386.1; 141/90; 141/9

[58] Field of Search ..... 53/386, 551, 554, 570, 53/578, 579, 171, 386.1; 141/90, 91

[56] References Cited

U.S. PATENT DOCUMENTS

| | | | |
|---|---|---|---|
| 2,524,908 | 10/1950 | Hartman et al. | 141/166 |
| 2,548,222 | 4/1951 | Kindseth | 141/166 |
| 3,382,644 | 5/1968 | Vogt | 53/562 X |
| 3,750,721 | 8/1973 | Hudson | 53/570 X |
| 4,318,431 | 3/1982 | Evans | 141/90 |
| 4,651,503 | 3/1987 | Anderson, III et al. | 53/440 |
| 4,724,656 | 2/1988 | Tanaka . | |
| 4,838,325 | 6/1989 | Bordini | 141/90 |
| 4,898,327 | 2/1990 | Sperry et al. | 141/90 X |

*Primary Examiner*—John Sipos

*Attorney, Agent, or Firm*—Sughrue, Mion, Zinn, Macpeak & Seas

[57] ABSTRACT

An automatic molten substance bagging method and system which facilitates introduction and extrusion of molten substance into and from a fixed volume member and performs extrusion of molten substance rapidly by reduced driving force. A carrying can in which a bag is received is first transported to a position below an injector, and vacuum attracting pads are moved toward and then away from each other on the opposite sides of the bag to attract by vacuum and open a mouth portion of the bag. Then, the bag in the attracted condition is lifted by the vacuum attracting pads until a nozzle of the injector is inserted into the open mouth portion of the bag, and then the mouth portion of the bag is clamped by clamp members, whereafter the carrying can is lifted a little. Then, molten substance is injected into the bag from the injector, and during such injection, the carrying can is lifted further. After a predetermined amount of molten substance is filled into the bag, the bag is released from the clamp members, and then the carrying can is lowered to a vertical position at which the carrying can is subsequently transported away from the position below the injector.

4 Claims, 14 Drawing Sheets

SMALL VOLUME FILLING

AUTOMATIC MOLTEN SUBSTANCE BAGGING METHOD AND SYSTEM

BACKGROUND OF THE INVENTION

1. Field of the Invention

This invention relates to an automatic molten substance bagging method and system for automatically filling a bag with a fixed amount of molten substance such as asphalt latex.

2. Description of the Prior Art

An automatic molten substance bagging system of the type mentioned is disclosed in U.S. Pat. No. 4,724,656 granted to the applicant of the present patent application. In the automatic molten substance bagging system, a paper bag is first supplied in a closed condition into a carrying can and transported to an inflator of the air jet type at which air is jetted into the paper bag to compulsorily inflate the paper bag, and then the paper bag is transported to a position below an injector at which the paper bag is attracted on the opposite faces thereof by a set of vacuum attracting pads to open a mouth portion of the paper bag. Then, while the paper bag is kept in the attracted condition, the paper bag is lifted at a stroke to a predetermined vertical position by the vacuum attracting pads until a nozzle of the injector is inserted into the open mouth portion of the paper bag while also the carrying can is lifted at a stroke to a predetermined vertical position. Then, the vacuum attracting pads on the opposite sides of the paper bag are advanced to close the mouth portion of the paper bag, and while the paper bag is maintained in such condition, molten substance is filled into the paper bag from the injector. After the paper bag is filled with a predetermined amount of molten substance, the paper bag is released from attraction by the vacuum attracting pads on the opposite sides, and then the vacuum attracting pads are retracted from the paper bag, whereafter the carrying can is lowered to the original vertical position at which it is to be transported by a conveyor system.

In this manner, in the automatic bagging system, when molten substance is to be filled into a paper bag, the inflator of the air jet type is employed to compulsorily inflate the papaer bag prior to a molten substance filling operation into the paper bag in order to subsequently allow molten substance to extend fully to any corner at the bottom of a paper bag.

Further in the automatic molten substance bagging system, a fixed volume member for determining an amount of molten substance to be filled into a paper bag is disposed such that an axis thereof extends in a horizontal direction, and a piston is fitted for sliding back and forth movement in the fixed volume member and connected to a piston rod of a hydraulic cylinder. The piston of the fixed volume member is thus moved band and forth by the hydraulic cylinder to introduce, on one side of the piston, molten substance into the fixed volume member while it extrudes, on the other side thereof, molten substance from within the fixed volume member.

Accordingly, introduction and extrusion of molten substance are performed alternately on the opposite sides of the piston. In order to achieve such control of flow of molten substance, at least four solenoid valves and a complicated controlling circuit for controlling the solenoid valves are required. Besides, high driving force is required to operate the piston of the fixed volume member to extrude molten substance from the fixed volume member.

Further in the automatic bagging system, molten substance which remains sticking to a valve piston and a lower end of the injector, which is provided to inject molten substance from the fixed volume member into a paper bag, after a nozzle of the injector is closed by the valve piston is blown off by air which is jetted only from a single jetting hole formed at the center of the valve piston. Accordingly, such remaining molten substance cannot be blown off clean. Besides, the closing property of the nozzle by the valve piston is not satisfactorily high.

SUMMARY OF THE INVENTION

It is an object of the present invention to provide an automatic molten substance bagging method which can cause molten substance to extend to any corner at the bottom of a paper bag without inflating the paper bag prior to a filling operation by means of an air jetting inflator and accordingly can omit an air jetting inflator thereby achieving reduction in production costs and simplification in operating process.

It is another object of the present invention to provide an automatic molten substance bagging system wherein introduction and extrusion of molten substance into and from a fixed volume member is facilitated and extrusion of molten substance is performed rapidly by reduced driving force.

It is a further object of the present invention to provide an automatic molten substance bagging system wherein molten substance remaining sticking to an injector can be blown off clean and the closing property of a nozzle of the injector is improved.

It is a still further object of the present invention to provide an automatic molten substance bagging system wherein filling of a paper bag with molten substance by a small amount at a low flow rate by means of a small volume filling machine after most part of the paper bag is filled with molten substance by means of a large volume filling machine can be performed under a fixed pressure without being influenced by a drop or a variation of a supply pressure of molten substance from a molten substance supply source.

In order to attain the objects, according to one aspect of the present invention, there is provided an automatic molten substance bagging method for filling molten substance, using an injector, into a bag which has been transported to a predetermined position below the injector together with a carrying can in which the bag is received, comprising the steps of holding the carrying can at a first vertical position, advancing a plurality of vacuum attracting pads toward each other on the opposite sides of the paper bag to attract the bag thereto by vacuum and then retracting the vacuum attracting pads away from each other to open a mouth portion of the bag, lifting, while the bag is held attracted to the vacuum attracting pads, the vacuum attracting pads until a nozzle of the injector is inserted into the open mouth portion of the bag, clamping the mouth portion of the bag by means of clamp members, lifting the carrying can from the first vertical position to a second vertical position, injecting molten substance into the bag from the injector while the mouth portion of the bag is held clamped by the clamp members, lifting the carrying can from the second position to a third position while injection of molten substance is proceeding, cancelling the clamping operation of the bag by the clamp members after a predetermined amount of molten substance is filled into the bag, and lowering the carrying can from the third vertical position to a vertical position which is either the first vertical position or another position lower than the first vertical position and at which the carrying can can be transported away from the predetermined position.

With the automatic molten substance bagging system of the present invention, a bag received in a carrying can and transported to a position below the injector is attracted from the opposite sides by the vacuum attracting pads and is opened at a mouth portion thereof. The bag is then lifted while it is held attracted to the vacuum attracting pads. Consequently, the nozzle of the injector is inserted into the open mouth portion of the bag. Then, the carrying can is first lifted from the first (lower) position to the second (intermediate) position at which it supports a lower end of the bag lifted by the vacuum attracting pads from below. After then, the mouth portion of the bag is clamped by the clamp members. Then, molten substance is injected into the bag from the injector. Thereupon, the weight of the molten substance is supported by the bag. In this instance, since the bag is clamped at the mouth portion thereof by the clamp members, it accepts injected molten substance while it remains in the suspended condition on the clamp members, and as the amount of molten substance injected into the bag increases, the bag is gradually spread laterally.

Then, after the bag is filled with a particular amount of molten substance, the carrying can is lifted from the second vertical position to the third (upper) position. Thereupon, the bag in which molten substance is injected is pushed up at a bottom portion thereof by the carrying can, and consequently, the bottom portion thereof is expanded by the weight of the molten substance in the bag so that the molten substance is extended to any corner of the bottom portion of the bag. After then, injection of molten substance proceeds while the weight of the bag in which molten substance is injected is supported from below by the carrying can. After the predetermined amount of molten substance is filled into the bag, the bag is released from the clamped condition by the clamp members, and then the carrying can is moved down from the third (upper) position together with the bag to the position at which it is subsequently transported away from the position below the injector.

According to another aspect of the present invention, there is provided an automatic molten substance bagging system, comprising an injector having a nozzle at a lower end thereof, the injector having a valve piston built therein for opening or closing the nozzle, a fixed volume member including a vertical cylinder connected to a molten substance supply source and a piston fitted for upward and downward sliding movement within a predetermined vertical stroke range in the cylinder, the fixed volume member being constructed such that the piston is pushed up by a pressure of molten substance pressure fed from the molten substance supply source to accept a predetermined amount of molten substance therein, an extruding actuator disposed above the fixed volume member for pushing down the piston to extrude molten substance from within the fixed volume member into the injector, a set of vacuum attracting pads disposed for advancing and retracting movement toward and away from each other on the opposite sides of a bag in a carrying can transported to a predetermined position below the injector and for attracting a mouth portion of the bag to open and close the same upon such advancing and retracting movement, a pad moving mechanism for lifting the vacuum attracting pads to cause the nozzle at the lower end of the injector to be inserted into the mouth portion of the bag which has been attracted and opened by the vacuum attracting pads and for lowering the vacuum attracting pads after the bag has been released from vacuum attraction by the vacuum attracting pads, a clamp device for clamping the mouth portion of the bag after insertion of the nozzle of the injector into the mouth portion of the bag and for cancelling such clamping after a fixed volume of molten substance is filled into the paper bag from the injector, and a lifter for receiving thereon a carrying can transported to the predetermined position below the injector, then lifting the carrying can from a first vertical position to a second vertical position after insertion of the nozzle of the injector into the mouth portion of the bag, then lifting the carrying can from the second vertical position to a third vertical position during injection of molten substance by the injector, and then lowering the carrying can from the third to the first position after cancellation of clamping by the clamp device.

With the automatic molten substance bagging system of the present invention, molten substance pressure fed from the molten substance supply source is automatically introduced only by the predetermined amount into the fixed volume member while pushing up the piston of the fixed volume member by the pressure thereof. Then, when the piston is pushed down by the extruding actuator, the predetermined amount of molten substance in the fixed volume member is extruded into the injector from which it is then filled into the bag. When molten substance is to be introduced into the fixed volume member, the nozzle of the injector is closed with the valve piston in the injector while, for example, a single solenoid valve interposed between the fixed volume member and the molten substance supply source is opened. On the other hand, when molten substance in the fixed volume member is to be extruded from the fixed volume member and injected from the injector into the bag, the solenoid valve is closed while the nozzle is opened.

The valve piston may have a conical recess formed on a lower face thereof and have a plurality of jetting holes formed at a deepest portion of the recess thereof for jetting air radially outwardly along an inner face of the recess, and the automatic molten substance bagging system may further comprise an auxiliary valve disposed above the valve piston for engaging with an inner periphery of the nozzle when the valve piston closes the nozzle, and a spring for urging the auxiliary valve downwardly to press the auxiliary valve against the inner periphery of the nozzle.

The automatic molten substance bagging system may further comprise a small volume filling machine for pouring, after the fixed amount of molten substance is filled, molten substance at a low flow rate into the bag while measuring a weight of molten substance filled in the bag until a predetermined weight is reached, and the small volume filling machine may include a small volume filling injector having a nozzle at a lower end thereof and having a valve piston built therein for opening and closing the nozzle, a receiver including a vertical cylinder connected to the molten substance supply source and a piston fitted for upward and downward sliding movement in the cylinder, the receiver being constructed such that the piston is pushed up by a pressure of molten substance pressure fed from the molten substance supply source to admit molten substance therein, and a pressurizing actuator disposed above the receiver for pushing down the piston of the small volume filling injector to extrude molten substance from within the receiver into the small volume filling injector. When molten substance is to be injected at a low flow rate into the bag by means of the small volume filling machine after most part of molten substance which is to be filled up into the bag is filled by means of the large volume filling machine, molten substance is first stored in the receiver and then extruded from the injector into the bag. Consequently, filling of molten substance at a low flow rate can be performed under a fixed pressure without being influenced by a drop or a variation of the pressure at which molten substance is supplied from the molten substance supply source.

The above and other objects, features and advantages of the present invention will become apparent from the following description and the appended claims, taken in conjunction with the accompanying drawings in which like parts are denoted by like reference characters all through the drawings.

DETAILED DESCRIPTION OF THE PREFERRED EMBODIMENT

Figure 1:
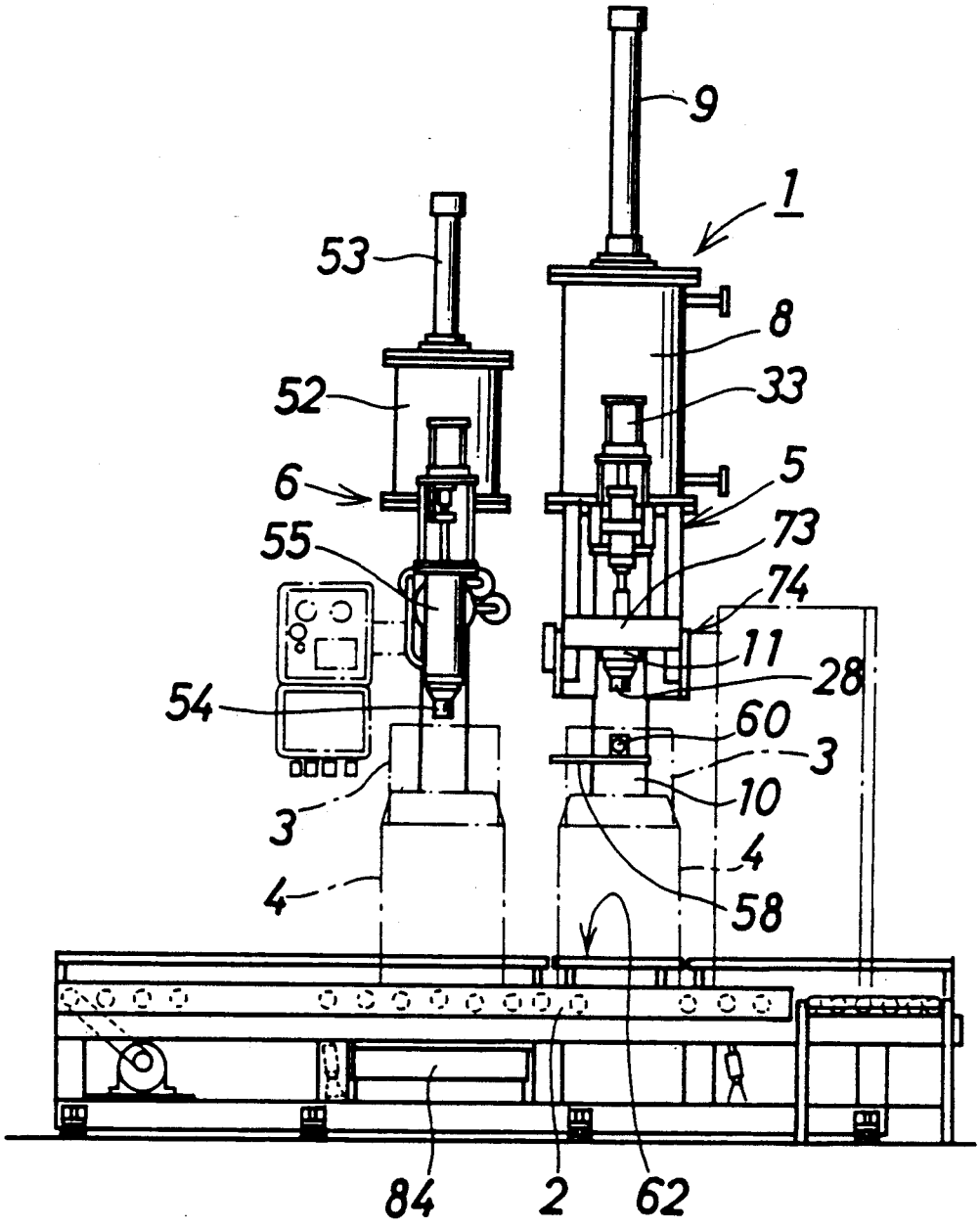
FIG. 1 is a front elevational view of an entire automatic bagging system to which the present invention is applied.
Figure 2:
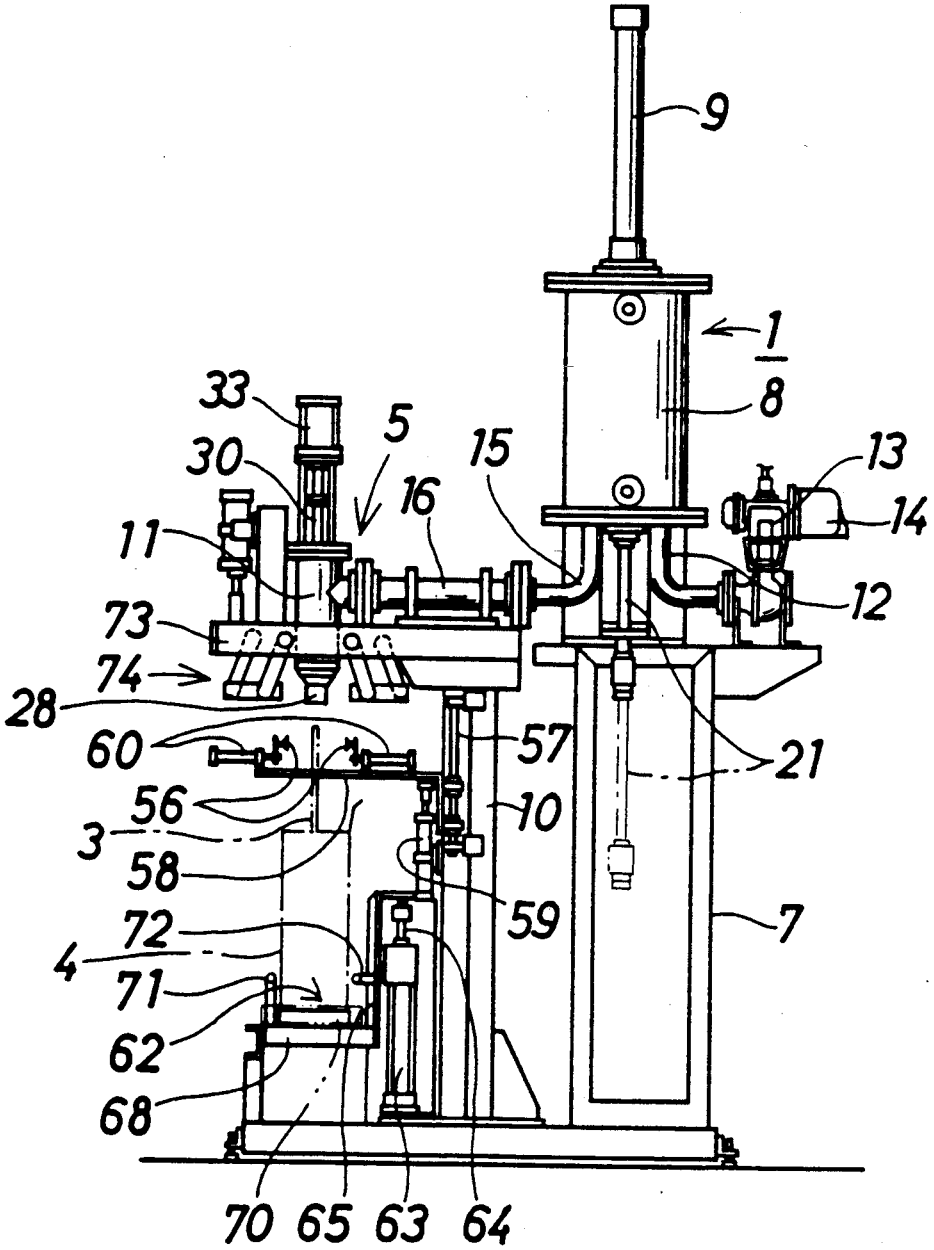
FIG. 2 is a side elevational view of the automatic bagging system of FIG. 1.
Figure 3:
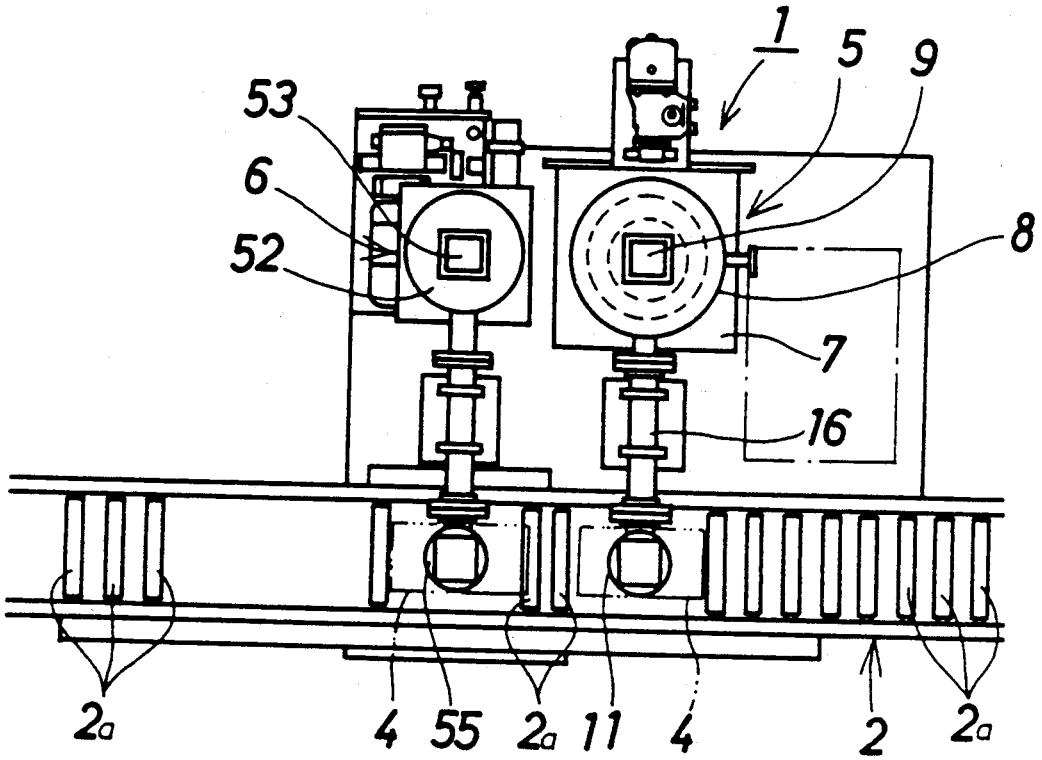
FIG. 3 is a top plan view of the automatic bagging system of FIG. 1.

Referring first to FIGS. 1 to 3, there is shown an entire automatic bagging system for filling asphalt latex into a paper bag according to the present invention. The automatic bagging system is generally denoted at 1, and a conveyor 2 extends leftwardly and rightwardly in FIG. 1 in front of the automatic bagging system 1. A carrying can 4 in which a paper bag 3 in a flatly folded condition is accommodated is transported leftwardly in FIG. 1 on the conveyor 2 to a predetermined position in front of the automatic bagging system 1 at which asphalt latex is filled into the paper bag 3 by the automatic bagging system 1, whereafter the carrying can 4 is transported leftwardly in FIG. 1 from the automatic bagging system 1 by the conveyor 2. The automatic bagging system 1 includes a large volume filling machine 5 and a small volume filling machine 6 in order to fill a paper bag 3 with molten substance at two successive steps by a large amount and a small amount, respectively. The large and small volume filling machines 5 and 6 are disposed in a juxtaposed relationship in this order in the transporting direction of the conveyor 2, and molten substance is filled first at a high flow rate by the large volume filling machine 5 until a fixed volume of a paper bag 3 little smaller than a predetermined specific volume is filled into the paper bag 3, and then molten substance is filled at a low flow rate by the small volume filling machine 6 while measuring the molten substance in the paper bag 3 until a predetermined weight (for example, 40 kg) is finally reached.

The large volume filling machine 5 includes, as shown in FIGS. 1 and 2, a fixed volume member 8 in the form of a cylindrical vessel placed vertically on a platform 7, an extruding hydraulic cylinder 9 mounted vertically on the fixed volume member 8, and a large volume injector 11 mounted vertically on a support post 10. The fixed volume member 8 is connected to an asphalt latex supply source not shown by way of an elbow 12 connected to the bottom of the fixed volume member 8, a solenoid valve 13 and a supply pipe line 14. The fixed volume member 8 is further connected to the injector 11 by way of another elbow 15 also connected to the bottom of the fixed volume member 8 and a connecting pipe 16 mounted horizontally on the support post 10.

Figure 4:
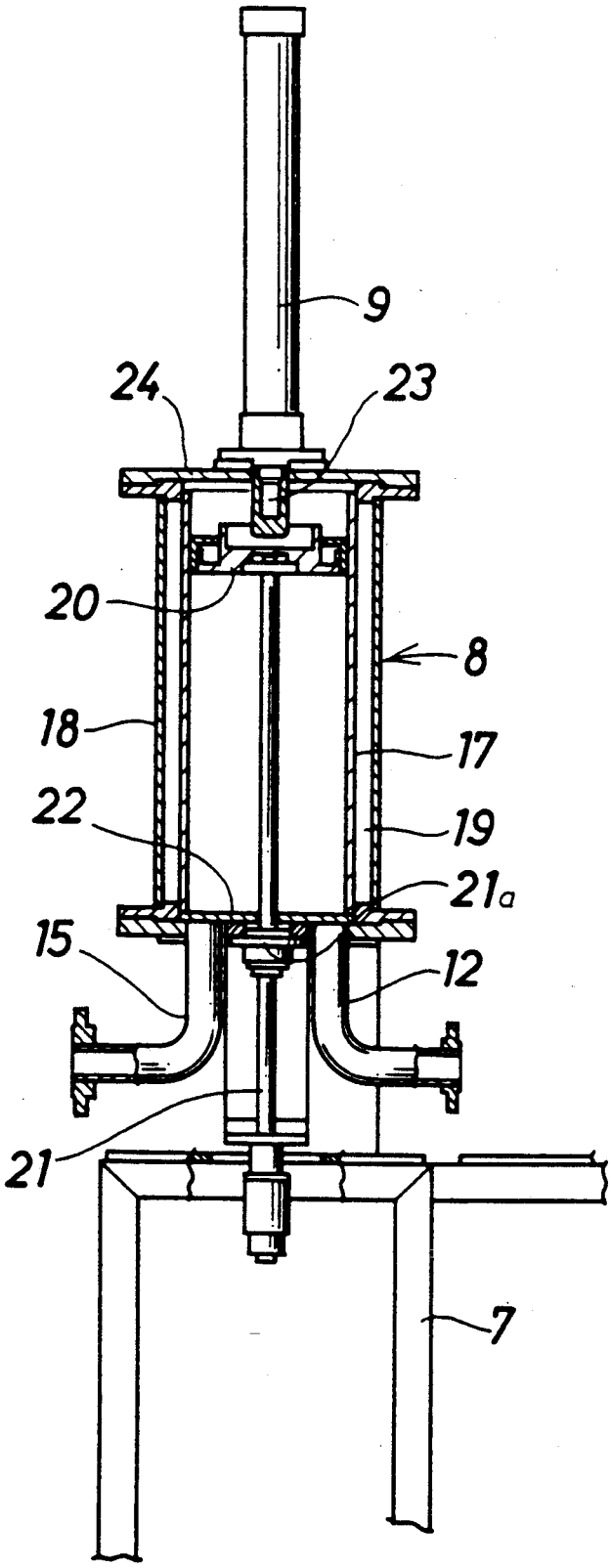
FIG. 4 is an enlarged axial sectional view of a fixed volume member of the automatic bagging system of FIG. 1.

Referring now to FIG. 4, there is shown an inner structure of the fixed volume member 8. The fixed volume member 8 has a double cylinder structure including an inner cylinder 17 and an outer cylinder 18 which define a steam heat retaining chamber 19 therebetween. In order to retain the heat of asphalt latex introduced in the inner cylinder 17, high temperature steam is fed into and circulated in the steep heat retaining chamber 19. A free piston 20 is fitted for upward and downward sliding movement in the inner cylinder 17. A stroke adjusting rod 21 for defining an upward stroke of the free piston 20 is securely connected to the center of a lower face of the free piston 20. The stroke adjusting rod 21 extends downwardly through a bottom lid 22 of the fixed volume member 8, and a stopper member **21*a* is adjustably mounted on the lower extension of the stroke adjusting rod 21 for engaging with the bottom lid 22 of the fixed volume member 8 to define an upper limit position of the stroke adjusting rod 21 and hence of the free piston 20. Thus, the upward stroke of the free piston 20 can be adjusted by adjustment of the stopper member 21*a* with respect to the stroke adjusting rod 21 from outside and below the inner cylinder 17**.

Heated molten asphalt latex from the asphalt latex supply source not shown is fed to the fixed volume member 8 under a predetermined fixed pressured by way of the supply pipe line 14. Accordingly, if the solenoid valve 13 is opened, then asphalt latex will be introduced into the inner cylinder 17 from below and push up the free piston 20. Since the free piston 20 is permitted to move upwardly only over a predetermined stroke determined by the stroke adjusting rod 21 described above, only a fixed amount of asphalt latex corresponding to the upward stroke of the free piston 20 is admitted into the inner cylinder 17.

A piston rod 23 of the extruding hydraulic cylinder 9 extends downwardly through an upper lid 24 of the fixed volume member 8 into the inner cylinder 17. Thus, when the piston rod 23 is moved downwardly, the free piston 20 is pushed down by the piston rod 23. Accordingly, if, after the fixed mount of asphalt latex is introduced into the inner cylinder 17 as described above, the solenoid valve 13 is closed and the free piston 20 is pushed down to its down stroke end by the piston rod 23, then the fixed amount of asphalt latex is extruded from the inner cylinder 17 into the injector 11 by way of the elbow 15. It is to be noted that a pneumatic cylinder may be used in place of the hydraulic cylinder 9.

Figure 5:
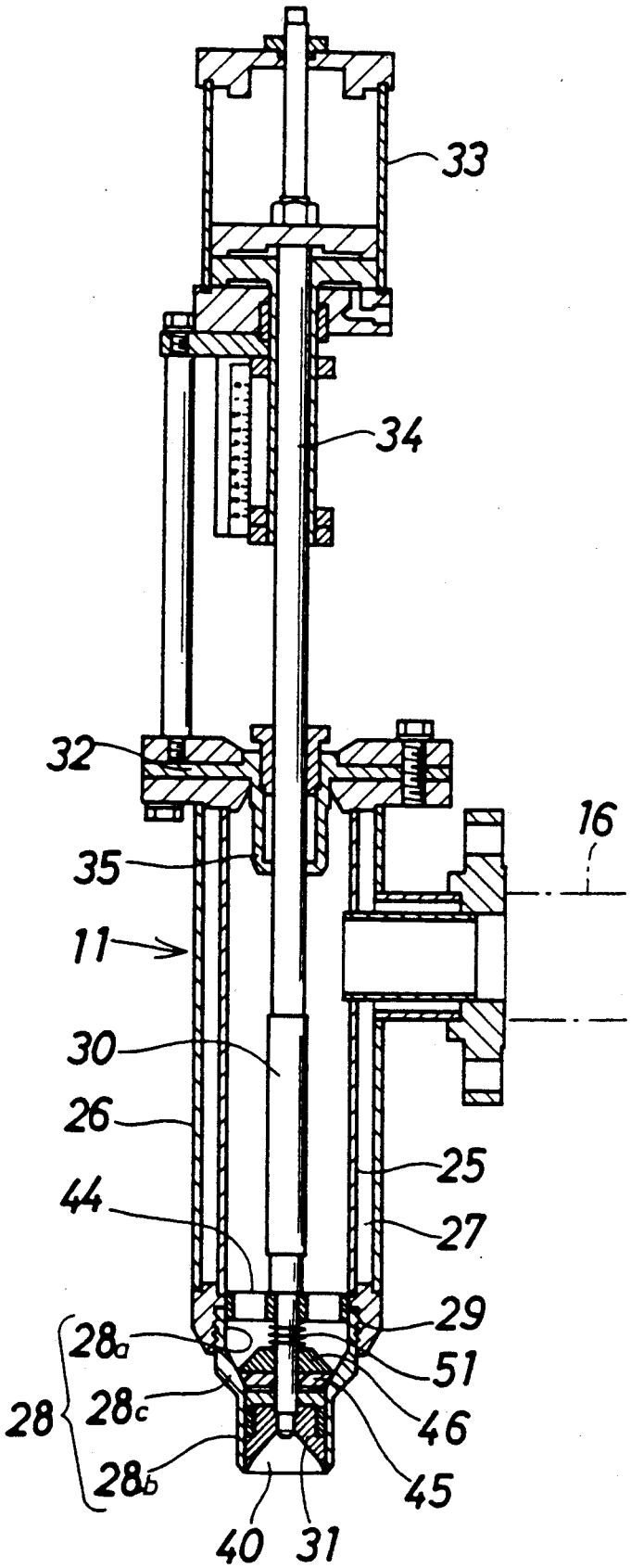
FIG. 5 is an enlarged sectional view of an injector of a large volume filling machine of the automatic bagging system of FIG. 1.

Referring to FIG. 5, there is shown an inner structure of the injector 11. Also the injector 11 has a double cylinder structure including an inner cylinder 25 and an outer cylinder 26 which define therebetween a steam heat retaining chamber 27, and high temperature steam is fed into and circulated in the steam heat retaining chamber 27. A nozzle 28 is removably secured to a lower end of the inner cylinder 25 by means of a screw member 29. The nozzle 28 has an upper portion **28*a* having an inner diameter equal to that of the inner cylinder 25, a lower portion 28*b* having inner and outer diameters smaller than those of the upper portion 28*a*, and an intermediate portion 28*c* extending between the upper and lower portions 28*a* and 28*b* and having inner and outer diameters which gradually decrease from the upper portion 28*a* to the lower portion 28*b*. A valve piston 31 is securely mounted at a lower end of a valve rod 30 and is fitted in the inner cylinder 25 for opening and closing the nozzle 28 from the inside of the nozzle 28. An opening/closing pneumatic cylinder 33 for moving the valve piston 31 upwardly and downwardly to open and close the nozzle 28 is mounted on an upper lid 32 common to the inner and outer cylinders 25 and 26. The valve rod 30 is integrally connected to a piston rod 34 of the pneumatic cylinder 33. The valve rod 30 is fitted for upward and downward sliding movement in a liquid-tight condition in a sleeve 35 mounted on the upper lid 32**.

Figure 6:
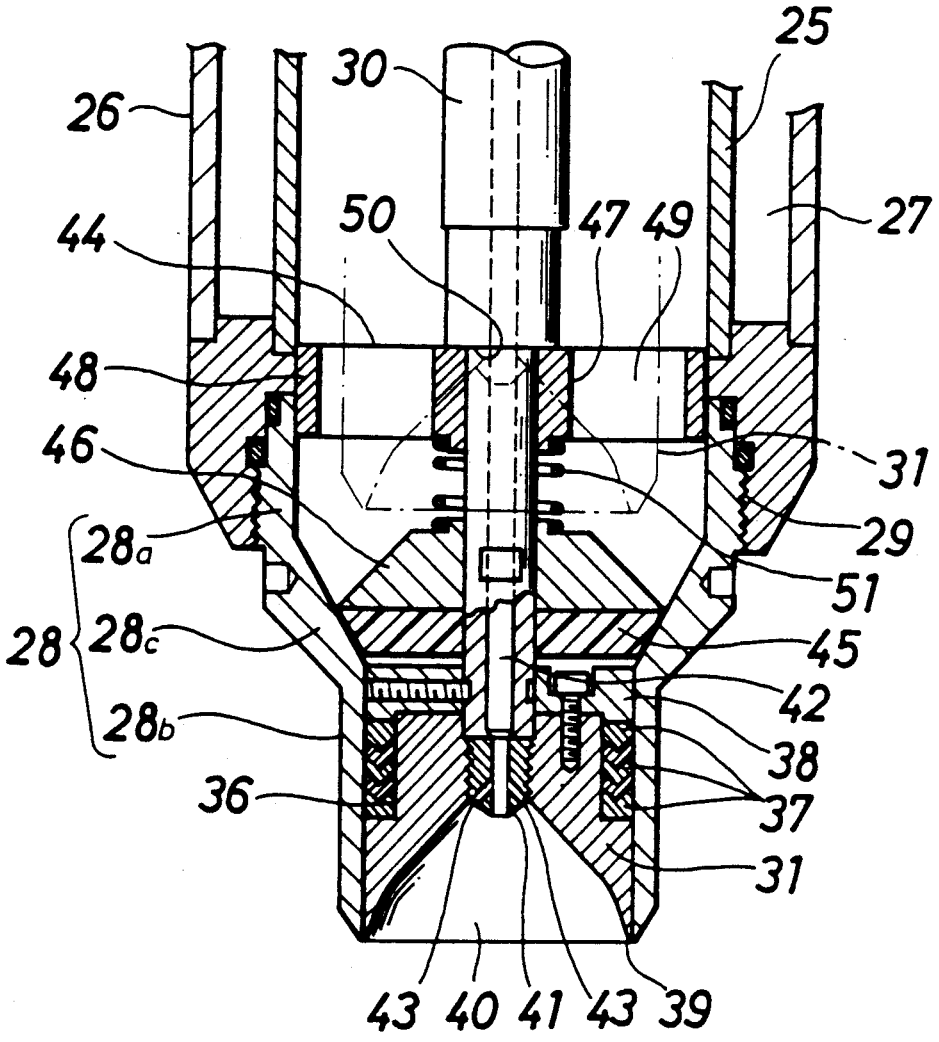
FIG. 6 is a further enlarged sectional view of a lower end portion of the injector shown in FIG. 5.

Referring now to FIG. 6, there are shown the valve piston 31 and nozzle 28 and their associated parts in an enlarged scale. The valve piston 31 has such a size that it is fitted for sliding movement in close contact in the lower portion **28*b* of the nozzle 28, and a plurality of V-shaped packing members 37 for the sealing between an inner periphery of the lower portion 28*b* of the nozzle 28 and an outer periphery of the valve piston 31 are disposed in a vertically overlapping relationship in a packing groove 36 formed on the outer periphery of the valve piston 31. A holding plate 38 is securely mounted on the valve piston 31 to securely hold the V-shaped packing members 37 on the valve piston 31. A conical recess 40 is formed on a lower face of the valve piston 31 leaving an annular peripheral edge 39 to provide a ring-shaped sharp blade at the lower end of the valve piston 31. An air jetting head 41 is screwed into a deepest portion at the center of the recess 40 of the valve piston 31 such that it is projected downwardly a little into the recess 40. An air passage 42 is formed in the valve rod 30 and extends long along an axial line of the valve rod 30 to the air jetting head 41, and compressed air is fed into the air passage 42 from the outside of the inner cylinder 25. The air jetting head 41 has a plurality of jetting holes 43 formed therein such that they branch radially outwardly from the air passage 42 to jet air along the conical face of the recess 40 of the valve piston 31**.

A guide wheel 44 is mounted on the valve rod 30 a little above the valve piston 31, and an auxiliary valve 45 and a valve holder 46 are mounted for upward and downward sliding movement on the valve rod 30 between the guide wheel 44 and the valve piston 31. The guide wheel 44 has a hub 47 fitted on the valve rod 30, a rim 48, and a plurality of arms 49 interconnecting the hub 47 and the rim 48. When the valve rod 30 is moved upwardly or downwardly, the rim 48 is slidably moved along the inner periphery of the inner cylinder 25. The valve rod 30 has a stepped portion 50 formed thereon for engaging with the hub 47 of the guide wheel 44. A coil spring 51 is interposed between the valve holder 46 and the hub 47 of the guide wheel 44 to normally urge the auxiliary valve 45 downwardly by way of the valve holder 46. The auxiliary valve 45 has such a truncated conical shape that it engages closely with part of an inner periphery of a truncated conical shape of the intermediate portion **28*c* of the nozzle 28 while the valve holder 46 has such another truncated conical shape inverse to that of the auxiliary valve 45**.

Asphalt latex extruded from the fixed volume member 8 is introduced into the inner tube 25 of the injector 11 by way of the connecting pipe 16. When asphalt latex is to be injected into a paper bag 3 from the injector 11, the valve piston 31 is moved up to a position indicated in phantom in FIG. 6 by means of the opening/closing pneumatic cylinder 33 to open the nozzle 28. In this instance, also the auxiliary valve 45 is moved up together with the valve piston 31 away from the nozzle 28. Thus, asphalt latex of a fixed amount extruded from the fixed volume member 8 is flowed out vertically downwardly under a fixed pressure through the nozzle 28 and injected into the paper bag 3.

When such injection is to be stopped, the valve piston 31 is pushed down by the opening/closing pneumatic cylinder 33 until it is fitted into the lower portion **28*b* of the nozzle 28 as indicated by solid lines in FIG. 6 to close the nozzle 28 from the inside while scraping off asphalt latex sticking to the inner face of the lower portion 28*b* by means of the valve piston 31. In this instance, since the auxiliary valve 45 is engaged with the truncated conical inner periphery of the intermediate portion 28*b* of the nozzle 28 and resiliently pressed against the inner periphery of the intermediate portion by the coil spring 51, the nozzle 28 is closed doubly by the valve piston 31 and auxiliary valve 45**.

After then, compressed air is fed into the air passage 42 of the valve rod 30 from the outside. Consequently, air is jetted from the jetting holes 43 of the air jetting head 41 along the conical face of the recess 40, and asphalt latex remaining sticking to the nozzle 28 and valve piston 31 will be blown off clean and injected into the paper bag 3.

When the piston rod 23 of the hydraulic extruding cylinder 9 is moved up after the nozzle 28 is closed as described above, asphalt latex from the asphalt latex supply source is introduced into the fixed volume member 8 while pushing up the free piston 20. Accordingly, fixed volume filling is performed repetitively.

Referring back to FIGS. 1 to 3, the small volume filling machine 6 is a little smaller in size and a little different in operation from the large volume filling machine 5 but is substantially similar in structure to the large volume filling machine 5. The small volume filling machine 6 includes a receiver 52 having a similar internal structure but having a smaller capacity than the fixed volume member 8, a pressurizing hydraulic cylinder 53 for pushing a free piston not shown in the receiver 52 to move downwardly to pressurize asphalt latex in the receiver 52, and a small volume filling injector 55 having a substantially same structure as the large volume filling machine 5 but including a nozzle 54 which is smaller than that of the injector 11 of the large volume filling machine 5. The small volume filling machine 6 is constructed to determine an amount of asphalt latex to be injected in accordance with a weight, and accordingly, a volume of asphalt latex need not be determined by the receiver 52. The receiver 52 is not necessarily required, but where it is provided, the following advantages can be anticipated.

In particular, in case the supply pressure of the asphalt latex supply source is not sufficiently high or varies over a wide range, asphalt latex will flow at a low flow rate for a long period of time from the small volume filling injector 55, that is, the period of time required until a fixed weight is reached will be very long, which will have a bad influence on other operations. Or, a flow of asphalt latex at the small volume filling injector 55 will not be cut well, and consequently, asphalt latex may drop onto and soil an outer face of another paper bag 3 which is fed to the small volume filling machine 6 after completion of filling by the large volume filling machine 5. Such problems are eliminated with the small volume filling machine 6 wherein, similarly as in the case of the fixed volume member 8, asphalt latex is introduced into the receiver 52 while pushing up the free piston by a supply pressure of the asphalt latex, and upon pouring by the small volume filling injector 55, the free piston is pushed down by the pressurizing hydraulic cylinder 53 to extrude asphalt latex under a fixed pressure toward the small volume filling injector 55.

Figure 7:
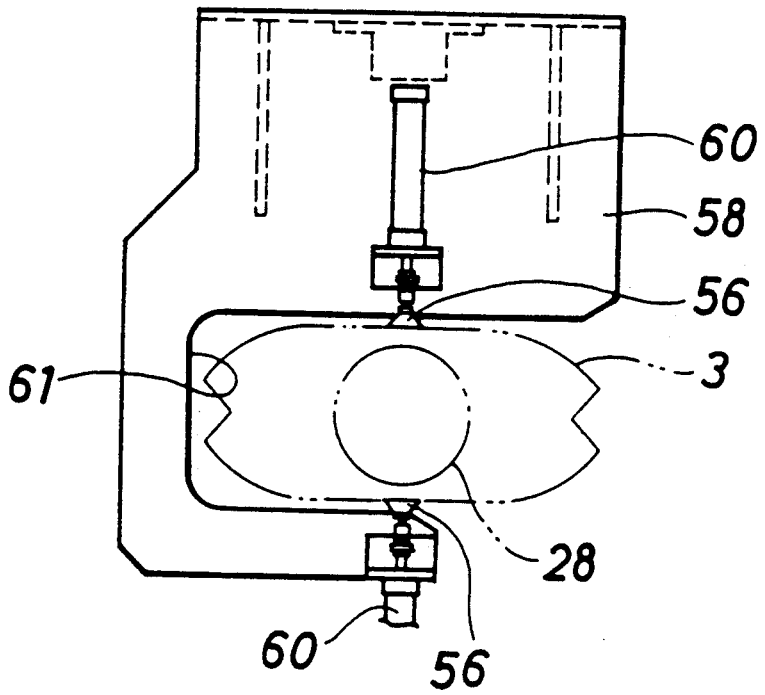
FIG. 7 is a plan view showing a paper bag which is attracted by vacuum attracting pads to open a mouth portion thereof.

Referring to FIG. 2, a set of vacuum attracting pads 56 for attracting a mouth portion of a paper bag 3 in a carrying can 4 from the opposite sides to open the mouth portion and lifting the paper bag 3 in the condition is mounted in the following manner below the injector 11 of the large volume filling machine 5. In particular, a horizontal lift base plate 58 is mounted for up and down movement on a guide rod 57 mounted vertically on the support rod 10. The lift base plate 58 is connected to be move up and down by a vertically moving pneumatic cylinder 59. A set of pneumatic cylinders 60 for moving the vacuum attracting pads 56 forwardly and backwardly are mounted in a mutually opposing relationship on the lift base plate 58, and the vacuum attracting pads 56 are securely mounted individually at ends of piston rods of the pneumatic cylinders 60. The lift base plate 58 has an opening or cutout 61 formed at a portion thereof between locations of the pneumatic cylinders 60 as seen in FIG. 7. The opening 61 has a size sufficient to allow a paper bag 3 with a mouth portion opened to pass therethrough. The pneumatic cylinders 60 for the vacuum attracting pads 56 are connected to a vacuum device not shown by way of air hoses not shown.

After a carrying can 4 is stopped at the predetermined position just below the injector 11 of the large volume filling machine 5 as hereinafter described, the pneumatic cylinders 60 are operated back and forth simultaneously with each other to move the vacuum attracting pads 56 forwardly and then backwardly toward and from each other. Consequently, a mouth portion of the paper bag 3 is attracted at central portions of outer faces thereof from the opposite sides and thus opened by the vacuum attracting pads 56 as shown in FIG. 7. After then, the lift base plate 58 is lifted to a predetermined vertical position along the guide rod 57 by the pneumatic cylinder 59. Consequently, the paper bag 3 is lifted, while it is held attracted by the vacuum attracting pads 56, to a predetermined vertical position at which the nozzle 28 of the injector 11 is inserted in the open mouth portion of the paper bag 3.

Figure 8:
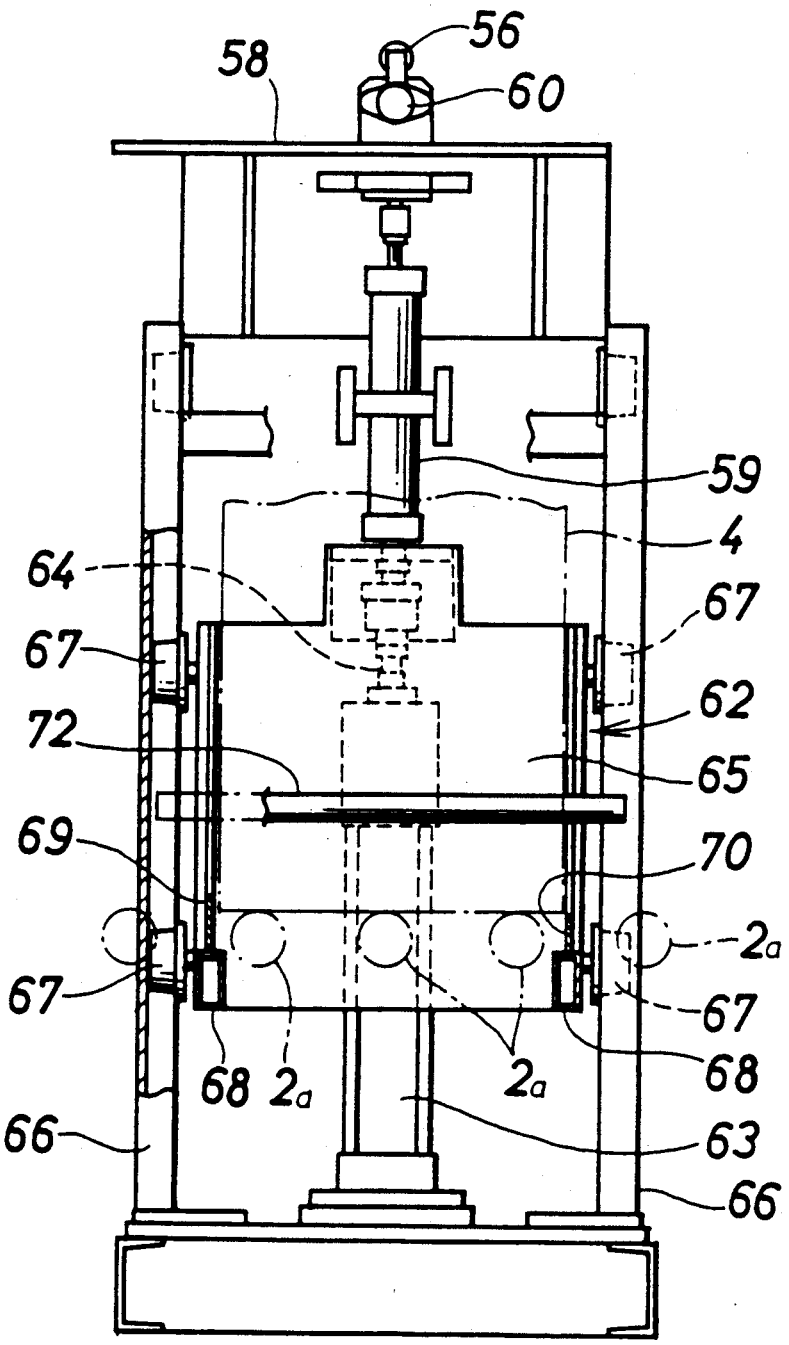
FIG. 8 is a front elevational view, partially in section, showing a lifter of the automatic bagging system of FIG. 1.

In order to lift a carrying can 4 after a paper bag 3 is opened and lifted in this manner, a lifter 62 for receiving and lifting a carrying can 4 thereon is disposed below the vacuum attracting pads 56 as shown in FIGS. 2 and 8. Referring to FIGS. 2 and 8, a vertical lift plate 65 is connected to a piston rod 64 of a pneumatic cylinder 63 which is provided for lifting the lifter 62. The lift plate 65 is located behind the conveyor 2, and two pairs of upper and lower rollers 67 are supported for rotation on the opposite left and right side edges of the lift plate 65 such that they may be rolled along a pair of vertical guide rails 66. The lift plate 65 is moved vertically along the guide rails 66 by the pneumatic cylinder 63. A pair of left and right arms 68 are formed in a spaced relationship from each other at and extend horizontally forwardly from a lower end of the lift plate 65 such that they can receive left and right end portions of the bottom of a carrying can 4 thereon. Each of the arms 68 is positioned in a gap between adjacent ones of rollers **2*a* which constitute the conveyor 2 so that it can pass, upon lifting or lowering movement of the lift plate 65, upwardly or downwardly between adjacent ones of the rollers 2*a*. The left and right arms 68 of the lift plate 65 have stopper plates 69 and 70 securely mounted vertically thereon, respectively, for preventing, when a carrying can 4 is received on the arms 68, inadvertent leftward or rightward movement of the carrying can 4 in FIG. 8 on the arms 68. The left-hand side stopper plate 69 normally extends to a position a little above a plane of the rollers 2*a* of the conveyor 2 as seen in FIG. 8 so that, when a carrying can 4 is transported leftwardly in FIG. 8 by the conveyor 2, it may be contacted with and stopped by the stopper arm 69 at a predetermined position at which it can be placed onto the arms 68 of the lift plate 65. Such stopping is detected by a sensor not shown. In order to prevent inadvertent forward or backward movement of a carrying can 4 placed on the arms 68 of the lift plate 65 and guide the carrying can 4 during leftward transportation in FIG. 8 on the conveyor 2, a front guide rod 71 is mounted on and extends horizontally between free ends of the arms 68 of the lift plate 65 while a rear guide rod 72 is mounted horizontally on a front face of the lift plate 65 as seen in FIG. 2**.

The left and right arms 68 for receiving a carrying can 4 thereon and hence the lift plate 65 can be moved to four different vertical positions by suitably controlling operation of the pneumatic cylinder 63. In particular, the arms 68 normally assume a first or lower position at which they are positioned a little lower than the plane of the rollers **2*a* of the conveyor 2 and a carrying can 4 can be stopped at the predetermined position by the left-hand side stopper plate 69. The arms 68 are moved upwardly from the first position to a second or intermediate position together with a carrying can 4 received thereon after a paper bag 3 is attracted and lifted to a predetermined vertical position by the vacuum attracting pads 56 as described hereinabove, and at the second position, the carrying can 4 supports, at a bottom portion thereof, a lower end of the paper bag 3 lightly from below. The arms 68 are further lifted, while injection from the injector 11 is proceeding, from the second position to a third or upper position to lift the carrying can 4 thereon to push up, at the bottom portion thereof, the lower end of the paper bag 3. The arms 68 are then lowered, after completion of such filling of a fixed amount of asphalt latex into the paper bag 3 as described above, from the third position to a fourth or lower limit position lower than the first position to place the carrying can 3 again onto the conveyor 2 to allow subsequent leftward transportation in FIG. 8 of the carrying can 3 by the conveyor 2. At the fourth position of the arms 68, the left-hand side stopper arm 69 is positioned a little below the plane of the rollers 2***a* of the conveyor 2.

Figure 9:
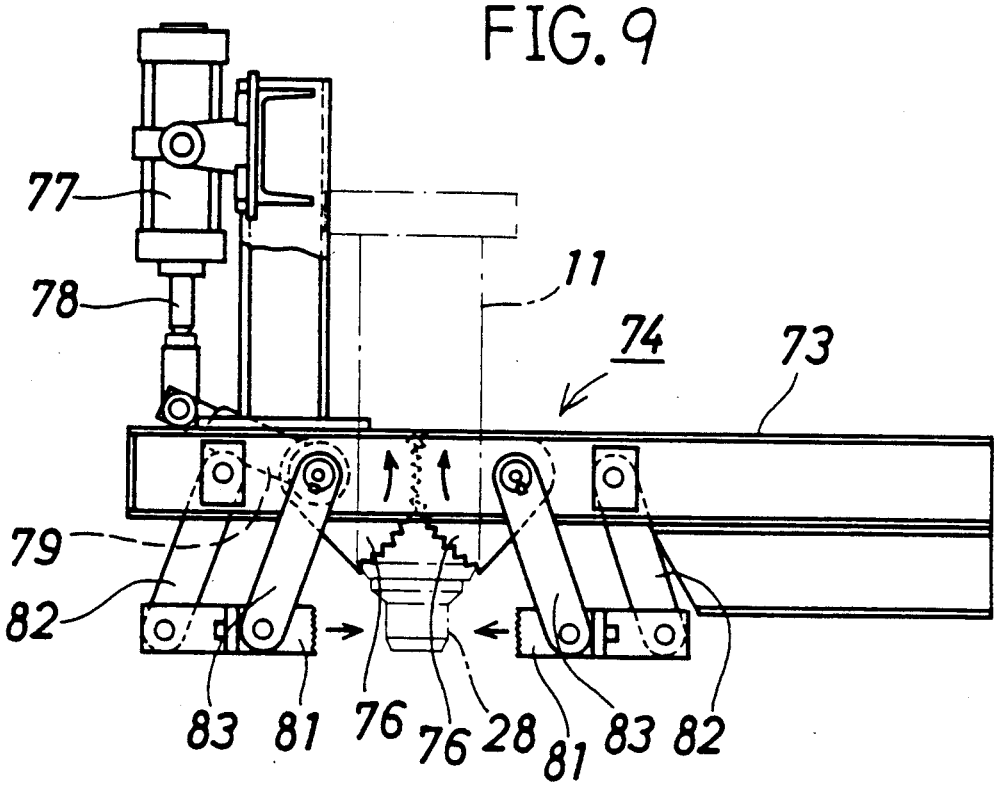
FIG. 9 is a side elevational view of a clamp device for clamping a mouth portion of a paper bag.
Figure 10:
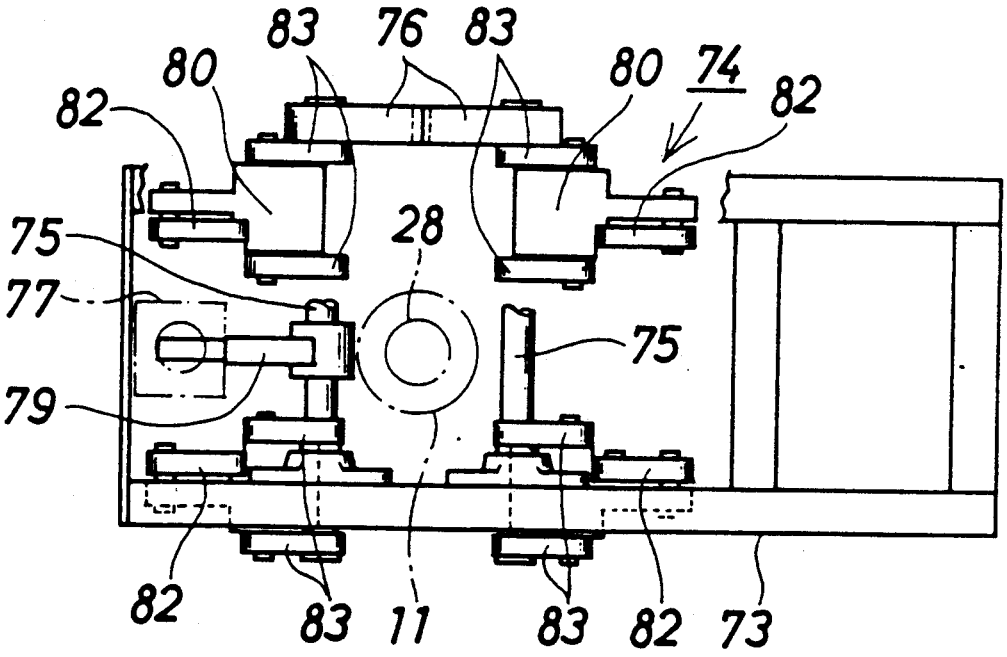
FIG. 10 is a plan view; partly broken, of the clamp device of FIG. 9.

Referring back to FIGS. 1 and 2, a clamp device 74 for clamping, at a predetermined vertical position, a mouth portion of a paper bag 3 attracted and lifted by the vacuum attracting pads 56 is disposed above the vacuum attracting pads 56. The clamp device 74 is mounted on a frame 73 which in turn is mounted on and extends horizontally forwardly from the support post 10. Referring also to FIGS. 9 and 10 in which the clamp device 74 is shown more in detail, a pair of front and rear shafts 75 are supported for rotation on the frame 73 and extend in parallel to each other. A pair of sector gears 76 are securely mounted on the shafts 75 and held in meshing engagement with each other and the front side shaft 75 is connected to a piston rod 78 of a pneumatic cylinder 77 by way of a crank 79 so that the two shafts 75 may be rotated simultaneously in the mutually opposite directions by the pneumatic cylinder 77. A pair of front and rear clamp members 80 and another pair of front and rear clamp members 81 are mounted respectively at left and right side portions of the frame 73 for parallel movement each by means of a link 82 pivotally mounted on the frame 73 and a pair of arms 83 securely mounted on a corresponding one of the shafts 75.

Accordingly, when the piston rod 78 of the pneumatic cylinder 77 is extended to rotate the sector gears 76 in opposite directions indicated by arrow marks in FIG. 9, the left-hand side front and rear clamp members 80 are moved toward each other while the right-hand side front and rear clamp members 81 are also moved toward each other so that the two sets of the clamp members 80 and 81 clamp, on the opposite left and right sides of the nozzle 28, a mouth portion of a paper bag 3 in which the nozzle 28 of the injector 11 is inserted as described hereinabove. Such injection of asphalt latex from the injector 11 is performed in this condition.

On the other hand, a weight measuring device 84 of a conventional construction for lifting the carrying can 4 to measure a weight of asphalt latex filled in a paper bag 3 in the carrying can 4 is disposed below the injector 55 of the small volume filling machine 6 as shown in FIG. 1.

The automatic bagging system has such structure as described above. Subsequently, a flow of operations of the automatic bagging system will be described with reference to schematic illustrations of FIGS. 11 to 18 and flow charts of FIGS. 19A, 19B and 19C.

Figure 11:
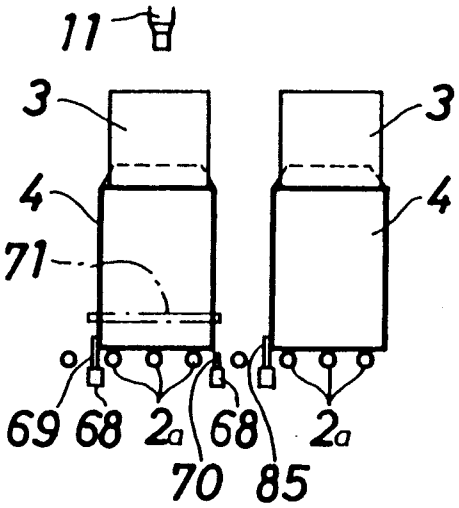
FIGS. 11 to 18 are schematic illustrations showing different steps of operation when a paper bag is filled with molten substance by the large volume filling machine.

In order that carrying cans 4 may be supplied one by one to the large volume filling machine 5 by the conveyor 2, each of the carrying cans 4 is stopped once at a position immediately before the large volume filling machine 5 by means of a carrying in stopper 85 as shown in FIG. 11. At the large volume filling machine 5, it is first detected, at step 101 of the flow charts of FIGS. 19A, 19B and 19C, by a carrying can sensor not shown that there is no carrying can 4 present just below the injector 11 of the large volume filling machine 5. At subsequent step 102 after such detection, the lifter 62 is lifted from the fourth or lower limit position to the first or lower position so that a carrying can 4 may be stopped by the left-hand side stopper plate 69. After then, the carrying in stopper 85 is retracted at step 103 to allow a carrying can 4 which has been stopped in a standby condition by the carrying in stopper 85 to be transported to the predetermined position just below the injector 11 of the large volume filling machine 5 at which it is stopped by the stopper plate 69. Then at step 104, it is detected by means of a bag sensor not shown whether or not there is a paper bag 3 present in the carrying can 4 at the predetermined position. If there is a paper bag 3 present, then the vacuum attracting pads 56 are moved down, at step 105, from their upper position to their lower position at which they can attract the paper bag 3.

Figure 12:
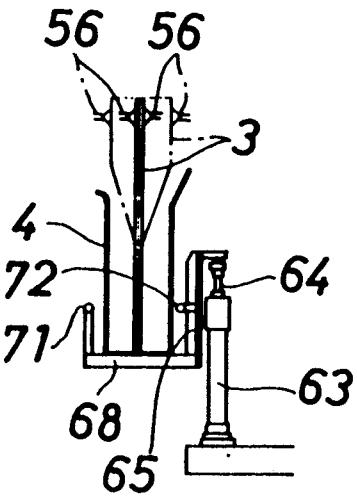
Figure 13:
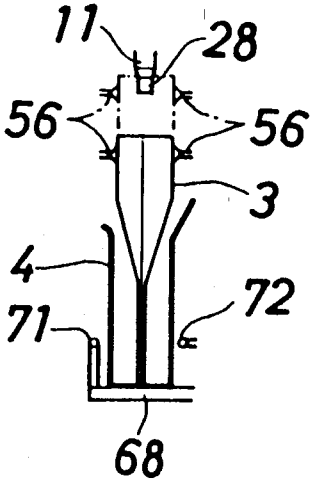
Figure 14:
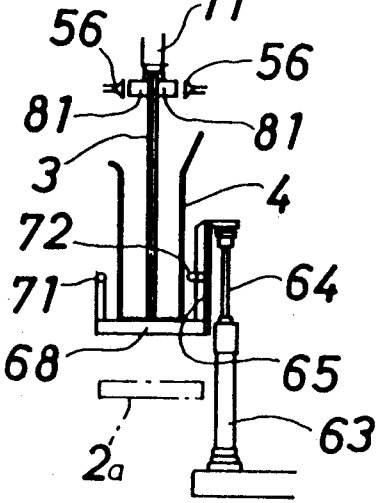

Subsequently at step 106, the vacuum attracting pads 56 are moved toward each other, and then at step 107, the vacuum attracting pads 56 are rendered operative to attract the paper bag 3 thereto by vacuum. Then at step 108, it is detected by means of a vacuum degree sensor not shown whether such vacuum attraction has been performed properly. If the paper bag 3 is attracted properly to the vacuum attracting pads 56, then the vacuum attracting pads 56 are moved away from each other, at step 109, to open a mouth portion of the paper bag 3 as shown in FIG. 12. Then at step 110, the vacuum attracting pads 56 are moved vertically to their upper position until the nozzle 28 of the injector 11 is inserted into the open mouth portion of the paper bag 3 as shown in FIG. 13. After then, the two sets of clamp members 80 and 81 are closed at step 111 to clamp the mouth portion of the paper bag 3 from the opposite sides as shown in FIG. 14, whereafter it is detected at step 112 by means of a clamp sensor not shown whether or not such clamping has been performed properly. If the paper bag 3 is clamped properly, then the control sequence advances to step 113 at which the lifter 62 is lifted from the lower or first position to the intermediate or second position so that a lower end of the paper bag 3 is supported lightly from below by a bottom portion of the carrying can 4 as shown in FIG. 14, and then at step 114, the vacuum attracting operation of the vacuum attracting pads 56 is stopped to release the paper bag 3 from the vacuum attracting pads 56.

Figure 16:
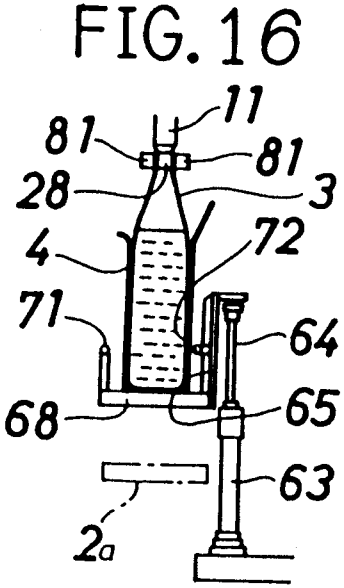
Figure 15:
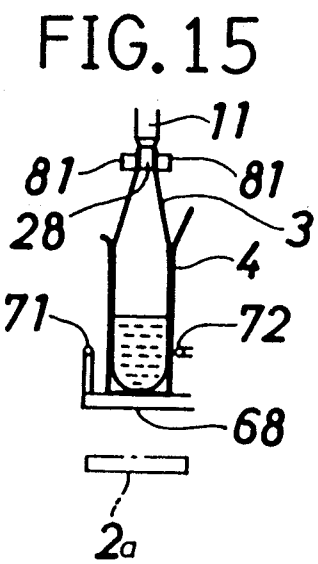

Subsequently the sequence advances to step 115 at which a large volume filling operation is started wherein asphalt latex from the fixed volume member 8 is injected at a high flow rate into the paper bag 3 from the injector 11. In this instance, since the paper bag 3 supports the weight of asphalt latex therein while it is held in a suspended condition on the two sets of clamp members 80 and 81 as seen in FIG. 15, a bottom portion thereof is spread by the weight of asphalt latex. At this stage, since the paper bag 3 is spread only by the weight of asphalt latex, there is the possibility that the bottom portion thereof may not be expanded sufficiently and asphalt latex may not extend to a corner of the bottom portion of the paper bag 3. Therefore, when the amount of injected asphalt latex comes, for example, to 30% or so of a final or aimed amount, the lifter 62 is lifted, at step 116, from the intermediate or second position to the upper or third position to push up the bottom portion of the paper bag 3 with the bottom portion of the carrying can 4 as shown in FIG. 16. Consequently, asphalt latex filled in the paper bag 3 is spread fully to any corner of the bottom portion of the paper bag 3 while the weight of the asphalt latex is supported on the carrying can 4. It is to be noted that such operation is performed by rendering the pneumatic cylinder 63 operative to lift the lifter 62 from the intermediate position to the upper position when a predetermined time as measured from starting of an injecting operation elapses or when an amount of asphalt latex as measured by a flow meter reaches a predetermined value.

Figure 18:
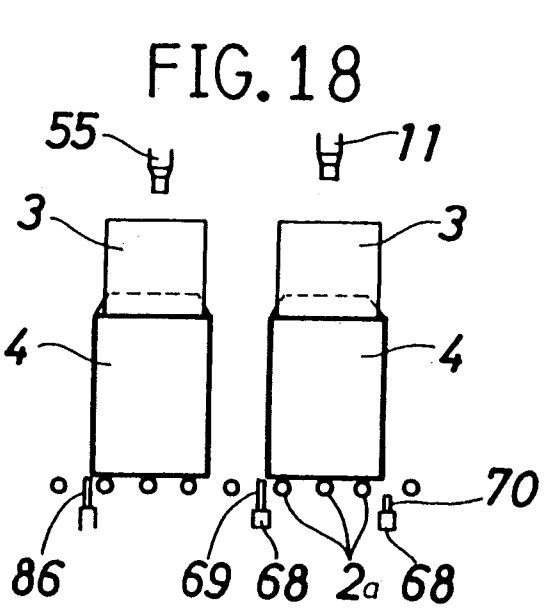
Figure 17:
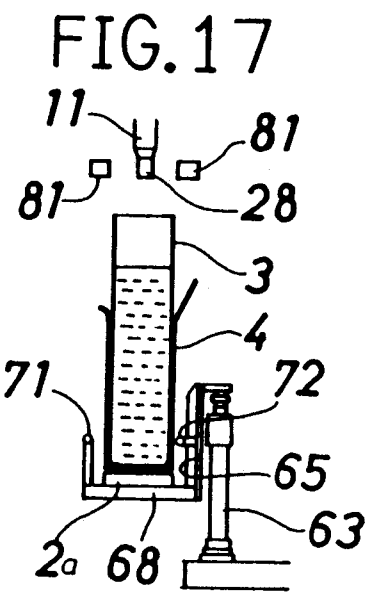
Figure 19A:
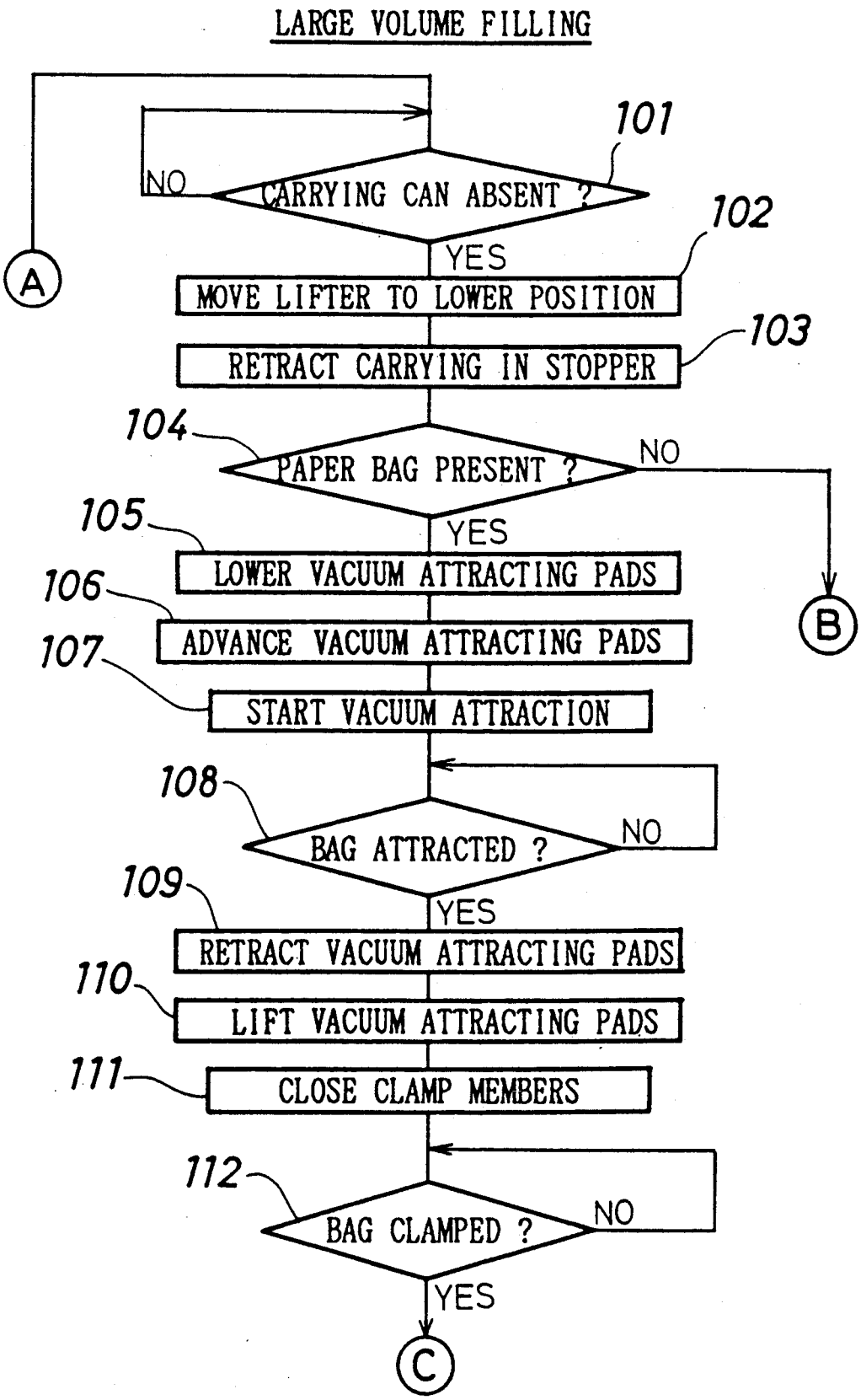
FIGS. 19A, 19B and 19C are flow charts illustrating operation of the volume filling machine and a small amount filling machine of the automatic bagging system of FIG. 1.
Figure 19B:
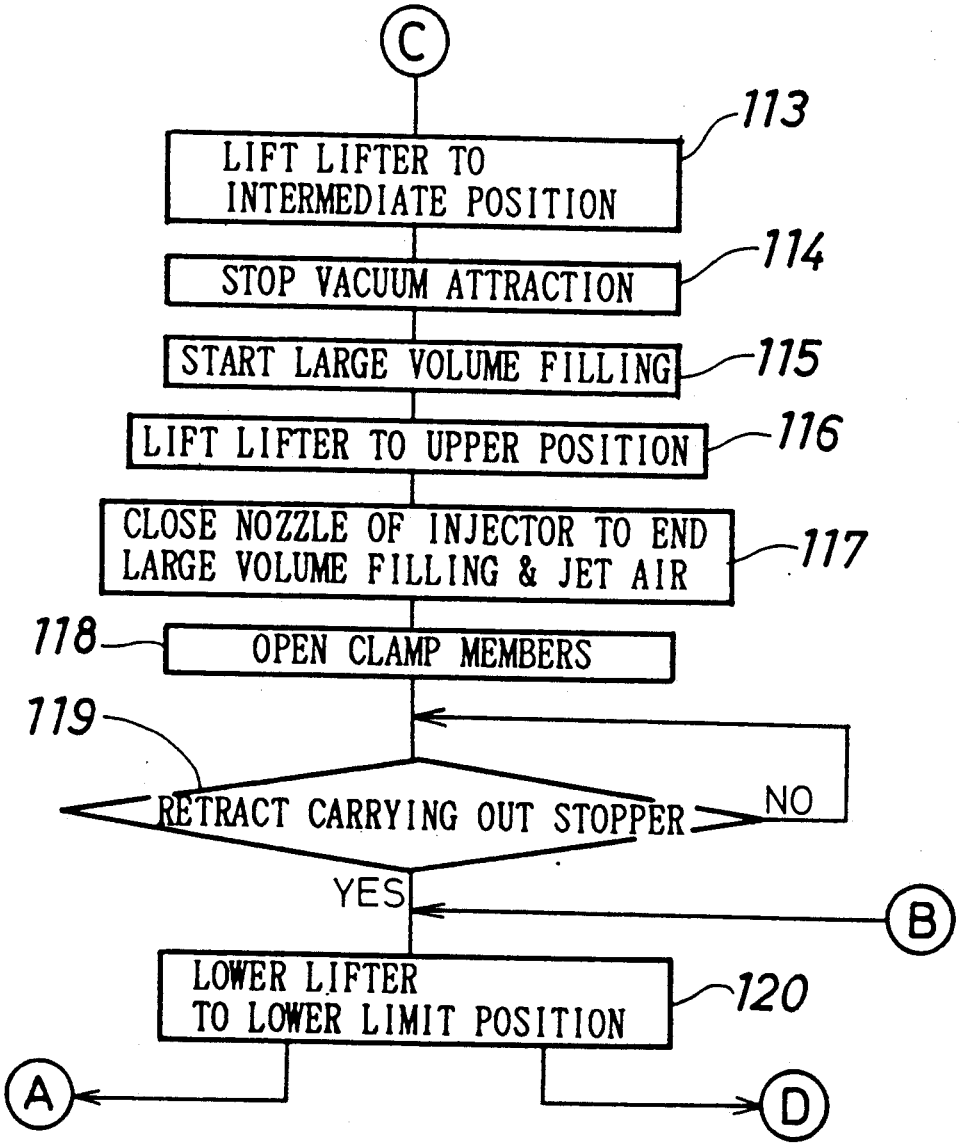
Figure 19C:
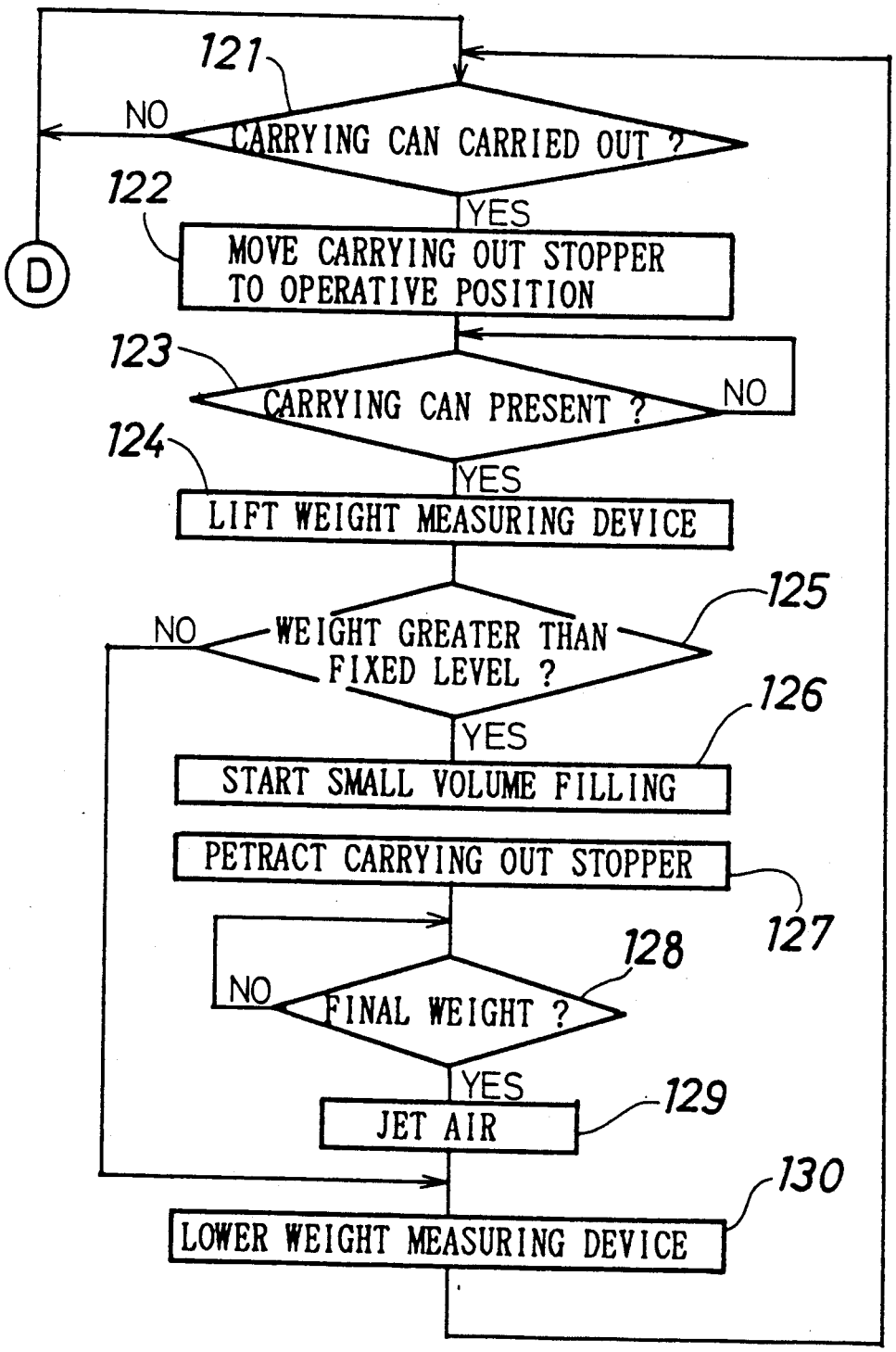

After the asphalt latex in the fixed volume member 8 is extruded completely, at step 117, the nozzle 28 is closed by the valve piston 31 of the injector 11, thereby completing the large amount filling operation, and air is jetted from the air jetting head 41 to blow off asphalt latex from the nozzle 28 and valve piston 31 into the paper bag 3 as described hereinabove. After then, at step 118, the clamp members 80 and 81 are moved away from each other to release the paper bag 3 as seen in FIG. 17. Then, in order to subsequently allow the conveyor 2 to carry out a carrying can 4 for which a filling operation by the small volume filling machine 6 has been completed, it is first judged at step 119 whether or not a carrying out stopper 86 shown in FIG. 18 is at its retracted position. Then, if the carrying out stopper 86 is at the retracted position, then the lifter 62 is moved down to the lowermost or fourth position at step 120. Upon such lowering movement of the lifter 62, the carrying can 4 for which the filling operation by the large volume filling machine 5 has been completed is received again by the conveyor 2 as shown in FIG. 17. Consequently, the carrying can 4 is then transported to the small volume filling machine 6 by the conveyor 2. Then, the sequence returns from step 120 to step 101 and the same sequence of operations is repeated on the large volume filling machine 5 side.

Meanwhile, on the small volume filling machine 6 side, it is detected at step 121 by a sensor not shown whether or not a preceding carrying can 4 has been carried away from the position just below the small volume filling injector 55. If the preceding carrying can 4 has been carried away already, then the carrying out stopper 86 is moved, at step 122, from the retracted position to an operative advanced position at which it stops the carrying can 4 after completion of large volume filling at the position just below the small volume filling injector 55. Then at step 123, it is detected by a sensor not shown whether or not there is a carrying can 4 present just below the injector 55, and if there is a carrying can 4 present, then the weight measuring device 84 is lifted, at step 124, to measure a weight of asphalt latex in the paper bag 3. Then, it is judged at step 125 whether or not the weight is greater than a predetermined fixed level (for example, 85% of the final or aimed weight of asphalt latex to be filled). If the weight is greater than the predetermined level, then the sequence advances to step 126 at which a small value filling operation is started wherein asphalt latex in the receiver 52 is injected at a low flow rate into the paper bag 3 from the injector 55, and then to step 127 at which the carrying out stopper 86 is retracted. Then at step 128, it is judged in accordance with an output of the weight measuring device 84 whether or not the final or aimed weight of asphalt latex has been reached, and if the final weight has been reached, then remaining asphalt latex is blown off into the paper bag 3 by injection of air at step 129. After then, at step 130, the weight measuring device 84 is moved down to place the carrying can 4 onto the conveyor 2 again. Consequently, the carrying can 4 is transported leftwardly from the small volume filling machine 6. After then, the sequence returns to step 121 to repeat the same sequence of operations.

Having now fully described the invention, it will be apparent to one of ordinary skill in the art that many changes and modifications can be made thereto without departing from the spirit and scope of the invention as set forth herein.

What is claimed is:

1. An automatic molten substance bagging method for filling molten substance, using an injector, into a bag which has been transported to a predetermined position below said injector together with a carrying can in which the bag is received, comprising the steps of:

holding the can at a first vertical position;

advancing a plurality of vacuum attracting pads toward each other on the opposite sides of the paper bag to attract the bag thereto by vacuum and then retracting said vacuum attracting pads away from each other to open a mouth portion of the bag;

lifting the bag held attracted to said vacuum attracting pads by lifting said vacuum attracting pads until a nozzle of said injector is inserted into the open mouth portion of the bag;

clamping the mouth portion of the bag by means of clamp members to the injector;

lifting the carrying can from the first vertical position to a second vertical position to lightly support a bottom portion of said bag;

injecting molten substance into the bag from said injector while the mouth portion of the bag is held clamped by said clamp members;

lifting the carrying can from the second position to a third position to lift the bottom portion of said bag is expanded by the weight of said molten substance and said molten substance extends to all corners of the bottom portion of the bag, while injection of molten substance is proceeding;

cancelling the clamping operation of the bag by said clamp members after a predetermined amount of molten substance is filled into the bag; and lowering the carrying can from the third vertical position to a vertical position which is either the first vertical position or another position lower than the first vertical position and at which the carrying can be transported away from the predetermined position.

2. An automatic molten substance bagging system, comprising:

an injector having a nozzle at a lower end thereof, said injector having a valve piston built therein for opening or closing said nozzle;

a fixed volume member including a vertical cylinder connected to a molten substance supply source and a piston fitted for upward and downward sliding movement within a predetermined vertical stroke range in said cylinder, said fixed volume member being constructed such that said piston is pushed up by a pressure of molten substance pressure fed from said molten supply source to accept a predetermined amount of molten substance therein;

an extruding actuator disposed above said fixed volume member for pushing down said piston to extrude molten substance from within said fixed volume member into said injector;

a set of vacuum attracting pads disposed for advancing and retracting movement toward and away from each other on the opposite sides of a bag in a carrying can transported to a predetermined position below said injector and for attracting a mouth portion of the bag to open and close the same upon such advancing and retracting movement;

a pad moving mechanism for lifting said vacuum attracting pads to lift said bag thereby causing said nozzle at the lower end of said injector to be inserted into the mouth portion of the bag which has been attracted and opened by said vacuum attracting pads and for lowering said vacuum attracting pads after the bag has been released from vacuum attraction by said vacuum attracting pads;

a clamp device for clamping the mouth portion of the bag to the nozzle after insertion of said nozzle of said injector into the mouth portion of the bag and for cancelling such clamping after a fixed volume of molten substance is filled into the paper bag from said injector; and a lifter for receiving thereon a carrying can transported to the predetermined position below said injector, then lifting the carrying can from a first vertical position to a second vertical position to lightly support a bottom portion of said bag after insertion of said nozzle of said injector into the mouth portion of the bag, then lifting the carrying can from the second vertical position to a third vertical position to lift the bottom portion of said bag and thereby expanding the bottom portion by the lifting and by the weight of said molten substance and said molten substance extends to all corners of the bottom portion of the bag during injection of molten substance by said injector, and then lowering the carrying can from the third to the first position after cancellation of clamping by said clamp device.

3. An automatic molten substance bagging system as claimed in claim 2, wherein said valve piston has a conical recess formed on a lower face thereof and has a plurality of jetting holes formed at a deepest portion of said recess thereof for jetting air radially outwardly along an inner face of said recess, and further comprising an auxiliary valve disposed above said valve piston for engaging with an inner periphery of said nozzle when said valve piston closes said nozzle, and a spring for urging said auxiliary valve downwardly to press said auxiliary valve against said inner periphery of said nozzle.

4. An automatic molten substance bagging system as claimed in claim 2, further comprising a small volume filling machine for pouring, after the fixed amount of molten substance is filled, molten substance at a low flow rate into the bag while measuring a weight of molten substance filled in the bag until a predetermined weight is reached, said small volume filling machine including a small volume filling injector having a nozzle at a lower end thereof and having a valve piston built therein for opening and closing said nozzle, a receiver including a vertical cylinder connected to said molten substance supply source and a piston fitted for upward and downward sliding movement in said cylinder, said receiver being constructed such that said piston is pushed up by a pressure of molten substance pressure fed from said molten substance supply source to admit molten substance therein, and a pressurizing actuator disposed above said receiver for pushing down said piston of said small volume filling injector to extrude molten substance from within said receiver into said small volume filling injector.

* * * * *